United States Patent [19]

Ruzek

[11] Patent Number: 4,494,484

[45] Date of Patent: Jan. 22, 1985

[54] HEAT EXCHANGER FOR A PROCESS GAS

[75] Inventor: Wolfgang Ruzek, Neftenbach, Switzerland

[73] Assignee: Sulzer Brothers Limited, Winterthur, Switzerland

[21] Appl. No.: 554,563

[22] Filed: Nov. 22, 1983

[30] Foreign Application Priority Data

Nov. 24, 1982 [CH] Switzerland ..... 6846/82

[51] Int. Cl.[3] ..... F22B 1/02

[52] U.S. Cl. ..... 122/34; 122/37; 122/335; 122/483; 165/160; 165/174

[58] Field of Search ..... 122/32, 33, 35, 36, 122/37, 161, 335, 338, 341, 367 R, 367 A, 467, 468, 483; 165/160, 174

[56] References Cited

U.S. PATENT DOCUMENTS

| | | | |
|---|---|---|---|
| 3,279,439 | 10/1966 | Ammon | 122/483 |
| 3,766,892 | 10/1973 | Webster | 122/32 |
| 4,073,267 | 2/1978 | Hunt et al. | 122/32 |
| 4,252,087 | 2/1981 | Kime | 122/367 R |
| 4,284,134 | 8/1981 | Harris | 122/32 |
| 4,285,393 | 8/1981 | Maus et al. | 122/32 |

*Primary Examiner*—Edward G. Favors
*Assistant Examiner*—Steven E. Warner
*Attorney, Agent, or Firm*—Kenyon & Kenyon

[57] ABSTRACT

The heat exchanger is constructed with a single pressure vessel to contain the ducts for the hot gas flow and the heating surfaces for the secondary medium. The heat exchanger is provided with a central duct for the hot process gas and two parallel branch ducts through which sub-flows of the process gas pass. A throttle member is provided in at least one of the branch ducts in order to throttle the flow of hot gas therethrough. Additional hot gas can be bypassed from the duct section into the exhaust gas from the pressure vessel.

20 Claims, 4 Drawing Figures

HEAT EXCHANGER FOR A PROCESS GAS

This invention relates to a heat exchanger. More particularly this invention relates to a heat exchanger for a process gas.

Heretofore, various types of heat exchangers have been known for dissipating sensible heat from a hot gas such as a process gas on a plurality of heat exchanger surfaces. Generally, the heat exchanger surfaces are disposed in ducts which are accommodated in different pressure vessels. As a result, these systems have been relatively complex and expensive. In addition, the fabrication and assembly of such a system has also been complicated and time consuming.

Accordingly, it is an object of the invention to provide a relatively simple heat exchanger for dissipating sensible heat from a hot gas.

It is another object of the invention to be able to dissipate sensible heat from a hot process gas within a relatively simple and inexpensive structure.

It is another object of the invention to provide a heat exchanger for dissipating the sensible heat of a hot process gas which can be assembled in a minimum of time.

It is another object of the invention to provide an operationally reliable heat exchanger which is of relatively simple and inexpensive construction.

Briefly, the invention provides a heat exchanger which is constructed of a cylindrical pressure vessel in which a duct section is provided for conveying a hot gas therethrough along with a pair of parallel branch ducts which extend from the duct section to convey parallel flows of hot gas therethrough and a mixing chamber which communicates with the branch ducts to receive and mix the parallel flows of hot gas. In addition, the heat exchanger has an evaporator heating surface in the duct section for conveying a working medium therethrough in heat exchange relation to the hot gas in the duct section. Also, a second heating surface is provided in one of the branch ducts and is connected to the evaporating heating surface for conveying the working medium therethrough in heat exchange relation with the hot gas in the branch duct. Likewise, a third heating surface is provided in the other branch duct for conveying a working medium therethrough in heat exchange relation with the hot gas in this branch duct. Further, an adjustable throttle member is provided in at least one of the branch ducts for throttling a flow of hot gas therethrough.

The construction of the heat exchanger is such that all of the heating surfaces are disposed in a single substantially cylindrical pressure vessel.

The heat exchanger can be used to advantage for very hot process gases. In addition, a proportional heat transfer to the different heat exchanger heating surfaces can be accomplished by adjusting the throttle member in the event of any variation in the heat transfer due to deposits on the heating surfaces.

The heat exchanger construction also permits an adjustment in the supply of the working or secondary medium to influence the temperature of this medium.

Each of the duct section and branch ducts in the heat exchanger may be constructed as annular ducts which are disposed coaxially of the pressure vessel. This provides a structure which is of compact construction with a minimum of unused space. The pressure vessel can therefore be relatively small and light. This, in turn, results in a reduction in the cost of the heat exchanger as well as in greater ease of transport and simpler and faster assembly.

The duct section and one of the branch ducts may also be coaxially aligned in order to facilitate construction while also providing smooth partitions.

The duct section and one of the branch ducts may also be constructed in an integrated manner so as to form an inner annular duct within the heat exchanger. This is particularly favorable in terms of operation because of the ready removability of the heating surfaces which are subjected to the maximum stress.

The pressure vessel may be disposed on a vertical axis in which case, a single coil heating surface may extend over the duct section and one of the branch ducts to form the evaporator heating surface and the heating surface for that branch duct. Further, the single coil heating surface may also have a plurality of involute tube panels with each tube panel including limbs parallel to the pressure vessel axis. This construction is particularly economical since the coil tubes can be made simply and the suspension of the tubes requires no special carrier means. In addition, the third heating surface may be formed as a helical heating surface. This construction enables the heating surface to be arranged in co-current and/or in counter-current manner. Since this third heat exchanger is subjected to a very high heat transfer, in the event of any leakage, the tubes in question can be readily blanked off without this resulting in excessively hot streams in the gas or primary medium.

Where a single coil heating surface is used to define the evaporator and heating surface in the duct section and coaxial branch duct, each limb of each tube panel is of smaller diameter in the duct section than in the branch duct. This provides the advantage that the heat transfer on the primary side is reduced in the maximum temperature range because of the reduced gas speed and, conversely, the heat transfer on the secondary side is increased by a higher medium speed. Both of these features result in a reduction of the tube wall temperature. In addition, this construction also permits a transverse flow in the branching zone without a considerable pressure drop.

A plurality of lugs may also be secured between respective limbs of the tube panels for spacing the limbs apart. This permits the coil tubes to be combined to form a compact annular package which can be readily suspended, for example from upwardly extending limbs at opposite ends. These upwardly extending limbs may also serve to feed and discharge the working medium to the respective tube panels.

The throttle member which is used in the heat exchanger may be in the form of a disc valve which is centrally disposed in the pressure vessel and located at a downstream end of one branch duct relative to the flow of gas therethrough. This valve may also span a blanked off cylindrical central duct disposed coaxially within the pressure vessel. This disc valve provides a simple and relatively small throttle member which is situated in a moderate temperature zone and which can be operated with a very simple drive.

The pressure vessel may also include a coaxial gas inlet at a bottom thereof and at least one lateral gas outlet near the bottom. These features give constructional and operational advantages since the internal fittings of the pressure vessel can be favorably arranged in terms of construction and readily removed when necessary.

The mixing chamber may also be communicated with the gas outlet via an annular chamber or space disposed between the outer branch duct and the inner wall of the pressure vessel. This provides a simple means of protecting the pressure vessel wall from excessive temperatures.

A means may also be provided to define an opening in a region between the duct section and the branch ducts for passage of a hot gas to the gas outlet of the pressure vessel. In addition, an adjustable closure means can be provided for selectively closing this opening. These constructions provide a means whereby the final temperature of the primary gas can be controlled The heat exchanger may also be constructed with a wall which defines the duct section and a second wall which separates the branch ducts. In this case, at least one of the walls can be axially adjustable so as to enable any deterioration of the heat transfer due to deposits on the evaporated heating surface to be readily corrected.

These and other objects and advantages of the invention will become more apparent from the following detailed description taken in conjunction with the accompanying drawings wherein.

Figure 1:
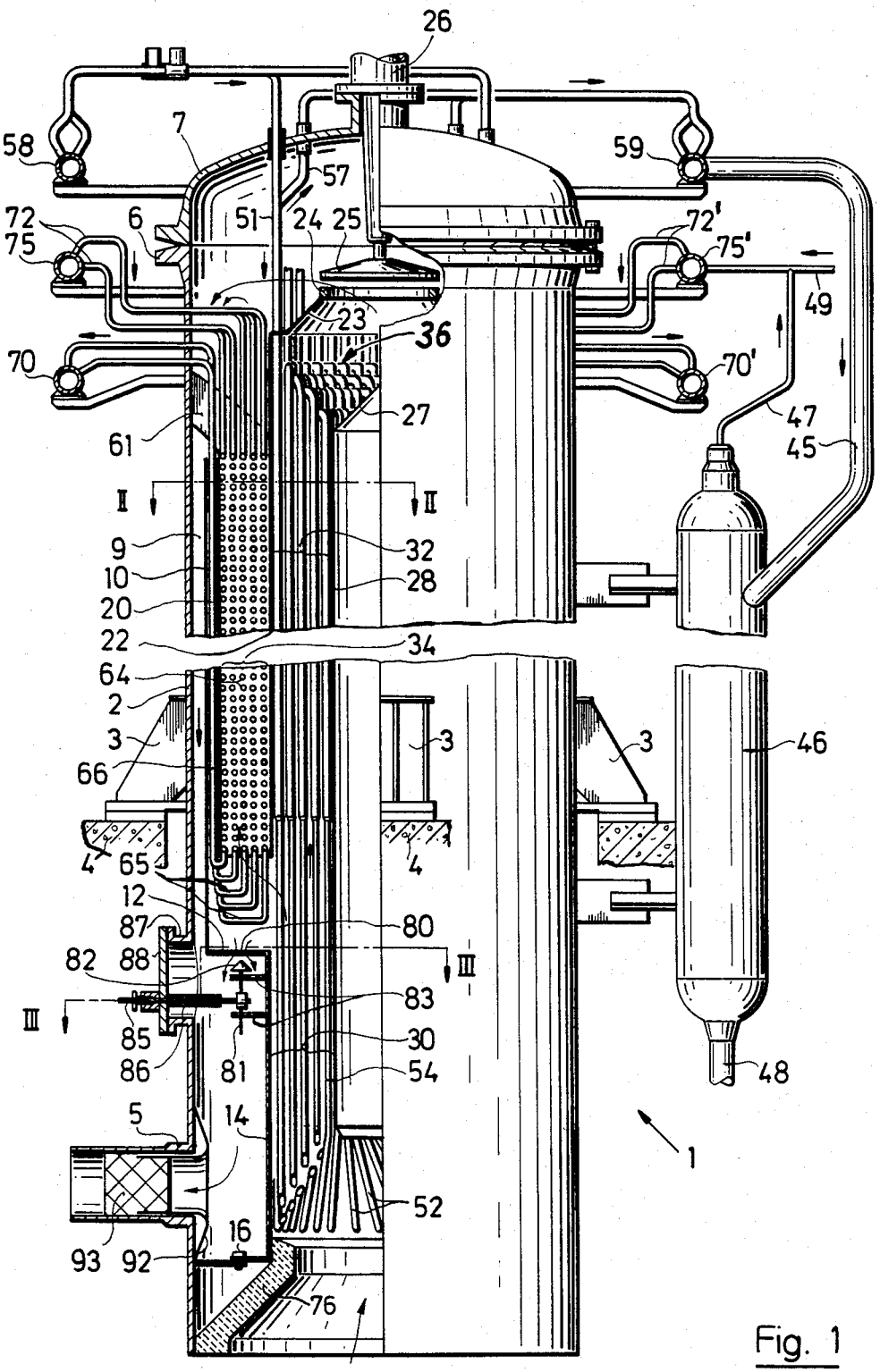
FIG. 1 illustrates a fragmentary and diagrammatic sectional view through a heat exchanger constructed in accordance with the invention.

Referring to FIG. 1, the heat exchanger includes a cylindrical pressure vessel 1 which has a tubular bottom part 2 mounted via support members 3 on a foundation 4. The bottom end of the bottom part 2 is connected to a gas inlet conduit (not shown) while a gas outlet 5 is disposed at the side just above the bottom end. The bottom part 2 of the pressure vessel 1 has a flange 6 at the top end on which a lid 7 is mounted to form the top of the pressure vessel 1.

A lining 10 extends over an extensive middle region of the height of the bottom part 2 and is spaced slightly from the inner wall of the bottom part 2 in order to form an annular chamber 9. The lining 10 terminates at the bottom at the periphery of an annular plate 12 and is connected in seal tight relationship with the annular plate 12. A cylindrical part 14 is also connected in seal tight relation to the inner edge of the annular plate 12 and at the bottom end is connected to the wall of the bottom part 2 via a seal tight but readily detachable connection 16.

An outer duct duct wall 20 extends at a slight radial distance from the lining 10 within the circular cylinder formed by the lining 10 and forms a portion of a tube which terminates at the bottom above the annular plate 12. A central duct wall 22 is disposed inside the cylindrical surface formed by the outer duct wall 20 and terminates at the bottom at substantially the same height as the outer duct wall 20. This central duct wall 22 carries a sheet metal cone 23 at the top with a valve seat 24 with which a throttle member 25 in the form of a disc valve which is actuated from a servomotor 26. An inner duct wall 28 is provided inside the central duct wall 22 and is also of circular cylindrical construction. The duct wall 28 is also closed at the top by a hollow sheet metal cone 27 and extends down beyond the central duct wall 22 some distance into the area of the partition 14.

The annular zone between the partition 14 and the inner duct wall 28 forms a duct section 30 for conveying a hot gas therethrough. Above the annular plate 12, the duct section 30 forks into two parallel branch ducts 32, 34 which are separated by the central duct wall 22. As indicated, the duct section 30 and the branch ducts 32, 34 are disposed coaxially of the pressure vessel 1 with the duct section 30 and the inner branch duct 32 being coaxially aligned to form an inner annular duct.

A single coil heating surface 36 extends over the entire height of the annular duct formed by the duct section 30 and the inner branch duct 32 and forms an evaporator heating surface within the duct section 30 and a heating surface in the branch duct 32. This coil heating surface 36 consists of thirty-six involute tube panels 38 each of whichis formed from a tube with vertically extending limbs parallel to the pressure vessel axis.

Figure 4:
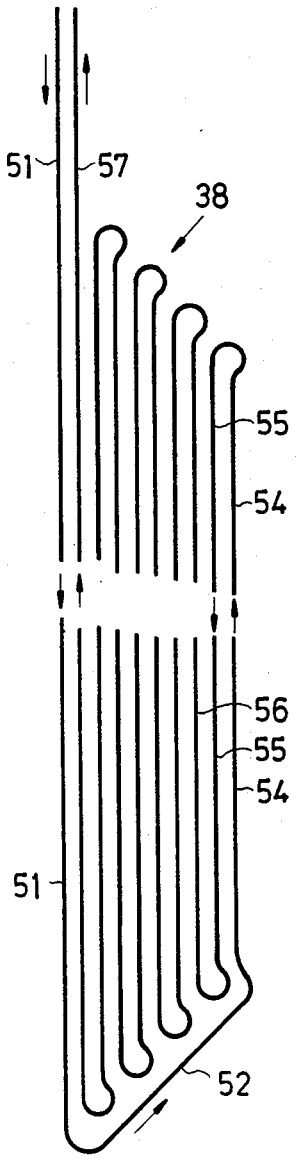
FIG. 4 illustrates a developed view of a tube panel consisting of coil tubes in accordance with the invention.
Figure 2:
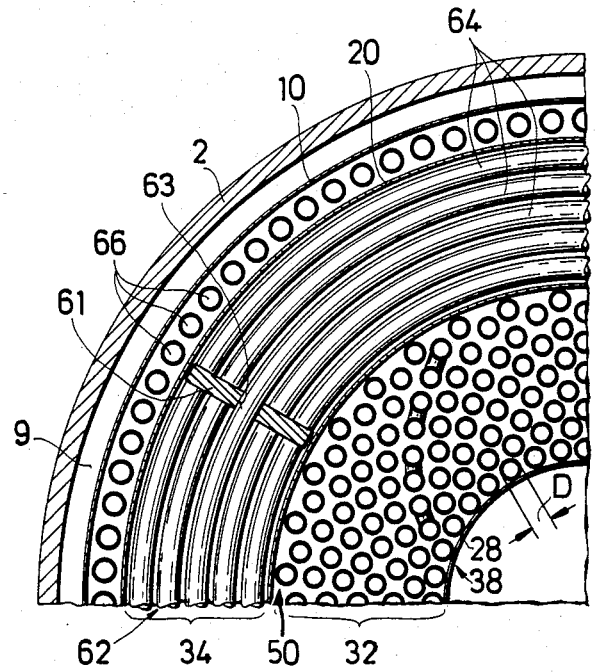
FIG. 2 illustrates a view taken on line II—II of FIG. 1.
Figure 3:
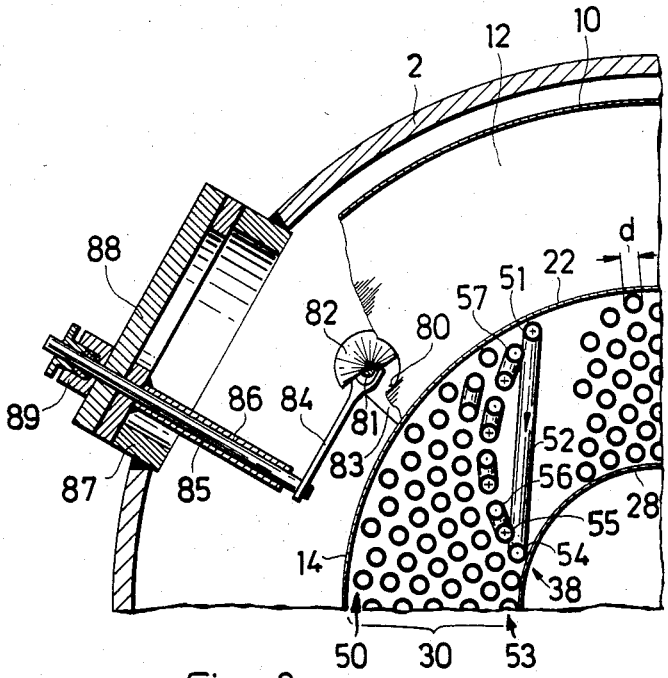
FIG. 3 illustrates a view taken on line III—III of FIG. 1.

Referring to FIGS. 2 to 4, each tube panel 38 has a vertical limb 51 lying on an outer tube cylinder 50 (FIG. 3) and connected at the bottom via an oblique portion 52 to a limb 54 lying on an inner tube cylinder 53. At the top, the limb 54 is connected via a bend to a limb 55 which is connected at the bottom to another limb 56 via a bend. After a repeated to-and-fro arrangement of the tube, one limb 57 leads vertically upwards and passes, together with the limb 51 through the sheet metal cone 23 via a sealing section (not shown). As indicated in FIG. 1, the limbs 51, 57 extend through the pressure vessel lid 7 via known sealing sleeves and are connected to a distributor 58 and a collector 59, respectively, along with the corresponding limbs of the other thirty five tube panels 38.

As shown in FIG. 1, all of the limbs of the panels 38 are reduced in diameter substantially at the level of the bottom end of the central duct wall 22. Thus, each limb has a small diameter d below this level (see FIG. 3) and a larger diameter D above this level (FIG. 2). The speed of flow of the gas in the duct section 30 is thus reduced and, at the same time, the speed of flow of the medium for evaporation is increased. Likewise, the heat transfer on the outside of the tubes 38 is reduced and increased on the inside of the tubes. This results in a lower temperature of the tube material. In addition, as a result of the smaller tube diameter the flow cross-section for the sub-flow of gas passing from the duct section 30 to the outer branch duct 34 is increased.

A plurality of lugs (not shown) are also secured between the tube limbs for spacing the limbs apart as well as between the tube panels 38. Alternatively, continuous ribs may be disposed in place of the lugs at different levels.

In order to produce the coil heating surface 36, the tube panels 38 are laminated on the inner duct wall 28, curved to involute surfaces and radially compressed by tensioning straps extending over the periphery of the heating surface 36. The resulting heating surface package is enclosed in the region of the inner branch duct 32 by means of braided wire and then by means of the central duct wall 22 which is welded together from two halves. The outer tube limbs 51 abut the partition 14 in the region of the duct section 30 so that the partition 14 is cooled during operation. Again, a wire braiding consisting of high temperature resistant material or an insulation may be provided, in a number of layers, if required, to reduce the heat transfer to the partition 14.

Means for improving the heat transfer may also be provided on the outside of the partition 14.

Referring to FIG. 2, a heating surface is also provided in the outer branch duct 34 in the form of a helical heating surface 62 consisting of ninety two helically coiled tubes 64 which form five tube cylinders. The tubes 64 are connected at the top ends via connecting tubes 72 which pass through the wall of the bottom part 2 to distributors 75, 75'. Each tube is also connected at the bottom end via a bend 65 to one of ninety two risers 66 which extend in the annular duct formed between the lining 10 and the outer duct wall 20. These risers 66 extend from the annular duct via a substantially gas tight passage (not shown) and pass out of the pressure vessel 1 at the side via temperature compensation spigots known as "thermosleeves", passing through the wall of the bottom part 2. As indicated, the risers 66 are connected to two collectors 70, 70'.

The tubes 64 of the helical heating surface 62 are held in perforate support plates 61 which are disposed inside the outer branch duct 34 in three planes which are offset 120° from one another and which extend through the vertical axis of the pressure vessel 1. The top ends of the support plates are laterally fixed to the wall of the bottom part 2 and have bores 63 over the height of the helical heating surface 62 through which the tubes 64 are coiled.

Referring to FIG. 3, the annular plate 12 is provided with two diametrically opposite circular openings 80. In addition, an adjustable closure means in the form of a valve cone 82 is provided for selectively closing each respective opening 80. As shown in FIG. 1, each valve cone 82 is disposed beneath an opening 80 in coaxial relation and is mounted on a valve rod 81. Each valve rod 81, in turn, is guided in arms 83 which are secured on the partition 14 and is coupled to a slotted forked lever 84 via a connecting pin (not shown). The forked lever 84 is, in turn, mounted on a shaft 85 which is rotatably mounted within a sleeve 86 which is removably secured to a suitable disposed pressure vessel spigot 87. As shown in FIG. 3, the shaft 85 passes through a flat cover 88 having a stuffing box 89 mounted thereon. The shaft 85 can be rotated from the outside in order to adjust the vertical position of the valve cone 82.

Referring to FIG. 1, the gas outlet spigot 5 is lined with a lining plate 92 which forms an inlet nozzle and which leads to a static mixer 93.

In the region of the height below the coil heating surface 36, the partition 14, connection 16 and bottom portion of the bottom part 2 are protected from excessive temperatures by masonary 76 which can contain cooling tubes (not shown).

The collector 59 is connected via a saturated steam line 45 to a separator 46. A steam outlet line 47 of the separator 46 leads to the distributors 75, 75' while an outlet 48 is provided at the bottom of the separator 46 to discharge separated water. Another steam feed line 49 is connected to the distributors 75, 75' and is connected at the upstream end, for example, to a cooling means or a boiler plant.

As indicated in FIG. 1, the outlets of the branch ducts 32, 33 lead into and communicate with a mixing chamber within which parallel flows of hot gas can be mixed prior to passage downwardly through the annular chamber 9 which communicates the mixing chamber with the gas outlet 5.

The heat exchanger operates as follows:

A process gas at a temperature, for example, of 1,000° C. and at a pressure of 20 to 40 bars is fed to the bottom end of the pressure vessel 1. This gas then flows through the duct section 30 wherein the gas is cooled to about 800° C. The gas is distributed at the level of the lateral opening between the annular plate 12 and the bottom edge of the central duct wall 22 to the branch ducts 32, 34. The gas continues to give off heat with the sub-flow in the inner branch duct 32 being cooled, for example to 320° C. while the sub-flow in the outer branch duct 34 is cooled, for example, to 380° C.

Downstream of the throttle member 25, the two gas flows combine in the common mixing chamber to give a mixed temperature, for example of 350°0 C. The combined gas flow then passes through the annular chamber 9, adjusting the temperature of the pressure vessel wall, into the annular chamber beneath the annular plate 12 and thence through the gas outlet spigot 5 for further use.

If the temperature of the gas at the outlet of the pressure vessel 1 is too low, hot gas is fed in through the openings 80 from the end of the duct section 30. This hot gas is admitted by turning the shaft 85, the valve cone 82 being lifted to varying degrees.

The lining plate 92, which may be assisted by additional baffle plates, keeps the hot gas streams from the openings 80 away from the load-bearing wall so that hot spots are avoided on the wall of the bottom part 2 or at the gas outlet 5.

After passing into the gas outlet 5, the gas temperature is made uniform by the static mixer 93.

Preheated water is fed as a secondary medium to the heat exchanger via the distributor 58 and is introduced into the coil heating surface via the limbs 51 which also act as support tubes. The coil heating surface 36 acts as an evaporator so that a mixture of steam and water flows into the collector 59 via the limbs 57. This mixture of steam and water is then separated in the separator 46. The separated water is then passed out via the spigot 48 while saturated steam is introduced into the distributors 75, 75' via the line 47. In addition, saturated steam from another source can be fed via the line 49 to the distributors 75, 75' as an auxiliary working medium. The saturated steam then flows via the connecting tubes 72, 72' into the helical heating surface 62 and heated in cross-counter-current to the hot gas. The resulting superheated steam then leaves the heat exchanger via the riser 66 and the collectors 70,70.

The heating surfaces in the duct section 30 and the branch ducts 32, 34 are constructed to be of a size to allow for soiling of the heating surfaces so that it is possible to initially operate with the throttle member 25 open to a smaller degree and with the openings 80 wide open. A considerable amount of heat is dissipated in the duct section 30 so that the branch duct 32 can be throttled accordingly. Since the inlet temperature in the outer branch duct is relatively low, there is no risk of the steam being superheated excessively. On the contrary, there is a relatively low mixed temperature of the gas mixture downstream of the two branch ducts 32, 34. The temperature of the gas emerging from the pressure vessel 1 is again raised to the required level by adding a relatively large quantity of hot gas via the openings 80.

If the heating surfaces are soiled, this will occur primarily in the duct section 30. The bottom part of the coil heating surface 36 will thus absorb inadequate heat. This can be corrected by further opening of the throttle member 25. Since the helical heating surface 62 is greatly over dimensioned, there is little risk that the required superheating temperature will not be reached.

In the above case of a fouled heating surface, the mixed temperature of the gas in the annular chamber 9 is higher than in the case of clean heating surfaces. Hence, the amount of gas flowing through the openings 80 is reduced by lifting the valve cone 82.

If the fouling of the heating surfaces progresses so intensively that the throttle member 25 has to be fully opened and the required temperatures can no longer be maintained, the lid 7 is lifted for cleaning of the heating surfaces. At this time, the central duct wall 22 which is suspended from the load carrying limbs 51, the coil heating surface 36 and the inner duct wall 28 are jointly removed. The central duct wall 22 can then be relatively easily detached from the cone 23 and separated into two halves so that the halves can be removed laterally.

After removal of the tensioning straps surrounding the coil heating surface 36, the tube panels 38 can be bent outwardly slightly, particularly in the middle and bottom part of the coil heating surface so that they can be cleaned. The helical heating surface 62 can then be inspected from within and also cleaned from within.

If the branch point appears to have been placed too low or too high in the construction of the heat exchanger, the partition 14 can be readily raised beyond the annular plate 12 or the central duct wall 22 can be shortened or extended downwardly. Alternatively, the branch point can be made adjustable, for example, by means of one or two annular valves or by a bypass provided in the central duct wall 22.

Of note, it may be advantageous for the ducts 30, 32, 34 to be defined at least partially by diaphragm walls, i.e. tubes welded together to form walls.

The heating surfaces of the heat exchanger are shown in the simplest form. However, these surfaces can also be subdivided and the directions of flow can be reversed completely or partially.

Further, more than one secondary medium may participate in the heat transfer. If throttle members are to be avoided in the pressure vessel, the throttle members can be located in the connecting pipes which carry the gas outside the pressure vessel. In order to distribute the heat transfer over different heating surfaces, the flow distribution of the secondary medium or media may be changed in certain circumstances.

The heating surfaces may also be constructed in a different form from that illustrated, for example blind tubes or heat tubes may be used.

Of note, the branch ducts can be staggered at different temperatures or temperature zones. Also, it is possible to stagger the combining of the branch flows.

The openings 80 may also be connected to lower temperature places on the inlet side of one or the other of the branch ducts. Depending upon the marginal conditions applicable, the arrangement of the ducts in the pressure vessel may be changed over or disposed in some other way. In order to facilitate blanking off individual tubes, particularly in the superheater tube nest, where higher temperatures occur, the connecting tubes 72 may be connected to tube plates, for example as described in Swiss Pat. No. 384,602.

In order to facilitate removal of the helical heating surface 62, the bottom part of 2 of the pressure vessel 1 may be divided by means of intermediate flanges below the places where the support plates 61 are secured.

The invention thus provides a heat exchanger which uses a single pressure vessel to contain the various ducts and heating surfaces for extracting sensible heat from a hot process gas. Further, the invention provides a heat exchange which can be readily constructed and which can be readily disassembled for cleaning of the various heating surfaces.

What is claimed is:

1. A heat exchanger comprising a cylindrical pressure vessel;

a duct section within said pressure vessel for conveying a hot gas therethrough;

a pair of parallel branch ducts extending from said duct section to convey parallel flows of the hot gas therethrough;

a mixing chamber communicating with said branch ducts to receive and mix parallel flows of hot gas therefrom;

an evaporator heating surface in said duct section for conveying a working medium therethrough in heat exchange relation with the hot gas in said duct section;

a second heating surface in one of said branch ducts and connected to said evaporator heating surface for conveying the working medium therethrough in heat exchange relation with the hot gas in said one branch duct;

a third heating surface in the other of said branch ducts for conveying a working medium therethrough in heat exchange relation with the hot gas in said other branch duct; and an adjustable throttle member in at least one of said branch ducts for throttling a flow of hot gas therethrough.

2. A heat exchanger as set forth in claim 1 wherein each of said duct section and said branch ducts is an annular duct disposed coaxially of said pressure vessel.

3. A heat exchanger as set forth in claim 1 wherein said duct section and said one branch duct are coaxially aligned.

4. A heat exchanger as set forth in claim 1 wherein said duct section and said one branch duct form an inner annular duct.

5. A heat exchanger as set forth in claim 4 wherein said pressure vessel is disposed on a vertical axis and a single coil heating surface extends over said duct section and said one branch duct to form said evaporator heating surface and said second heating surface, said single coil heating surface having a plurality of involute tube panels with each tube panel including limbs parallel to said pressure vessel axis.

6. A heat exchanger as set forth in claim 5 wherein said third heating surface is a helical heating surface.

7. A heat exchanger as set forth in claim 5 wherein each said limb of each tube panel has a length of small diameter in said duct section and a length of larger diameter in said one branch duct.

8. A heat exchanger as set forth in claim 7 further comprising a plurality of lugs secured between respective limbs for spacing said limbs apart.

9. A heat exchanger as set forth in claim 8 wherein each tube panel has a pair of upwardly extending limbs at opposite ends for feeding and discharging the working medium and for suspending said tube panel within said vessel.

10. A heat exchanger as set forth in claim 1 wherein said throttle member is a disc valve centrally disposed in said pressure vessel and located at a downstream end of said one branch duct relative to the flow of hot gas therethrough.

11. A heat exchanger as set forth in claim 1 wherein said pressure vessel includes a coaxial gas inlet at a bottom thereof and at least one lateral gas outlet near said bottom.

12. A heat exchanger as set forth in claim 11 which further comprises an annular chamber within said vessel communicating said mixing chamber with said gas outlet, said annular chamber being disposed between said other branch duct and said pressure vessel.

13. A heat exchanger as set forth in claim 12 which further comprises means defining an opening in a region between said duct section and said branch ducts for passage of hot gas to said gas outlet and an adjustable closure means for selectively closing said opening.

14. A heat exchanger as set forth in claim 1 further comprising a first wall defining said duct section and a second wall separating said branch ducts, at least one of said walls being axially adjustable.

15. A heat exchanger as set forth in claim 1 wherein said third heating surface communicates with said second heating surface to receive working medium therefrom and which further comprises means for delivering a second working medium to said third heating surface.

16. A heat exchanger comprising a cylindrical pressure vessel;

a duct section within said pressure vessel for conveying a hot gas therethrough;

a pair of parallel branch ducts extending from said duct section to convey parallel flows of the hot gas therethrough;

a mixing chamber communicating with said branch ducts to receive and mix parallel flows of hot gas therefrom;

an evaporator heating surface in said duct section for conveying a working medium therethrough in heat exchange relation with the hot gas in said duct section;

a second heating surface in one of said branch ducts and connected to said evaporator heating surface for conveying the working medium therethrough in heat exchange relation with the hot gas in said one branch duct;

a third heating surface in the other of said branch ducts for conveying a working medium therethrough in heat exchange relation with the hot gas in said other branch duct;

an adjustable throttle member in at least one of said branch ducts for throttling a flow of hot gas therethrough;

at least one lateral gas outlet near said bottom; and an annular chamber within said vessel communicating said mixing chamber with said gas outlet, said annular chamber being disposed between said other branch duct and said pressure vessel.

17. A heat exchanger as set forth in claim 16 wherein said duct section and said one branch duct are coaxially aligned.

18. A heat exchanger as set forth in claim 16 wherein said throttle member is a disc valve centrally disposed in said pressure vessel and located at a downstream end of said one branch duct relative to the flow of hot gas therethrough.

19. A heat exchanger as set forth in claim 16 which further comprises means defining an opening in a region between said duct section and said branch ducts for passage of hot gas to said gas outlet and an adjustable closure means for selectively closing said opening.

20. A heat exchanger as set forth in claim 16 wherein said third heating surface communicates with said second heating surface to receive working medium therefrom and which further comprises means for delivering a second working medium to said third heating surface.

* * * * *